United States Patent [19]

Schulze, Jr.

[11] 4,452,444

[45] Jun. 5, 1984

[54] REBOUND EXERCISER

[75] Inventor: Everett E. Schulze, Jr., Aurora, Colo.

[73] Assignees: Imagination Properties, Inc.; Carpenter & Associates, both of Lakewood, Colo.

[21] Appl. No.: 289,322

[22] Filed: Aug. 3, 1981

[51] Int. Cl.[3] ..... A63B 5/18

[52] U.S. Cl. ..... 272/65; 5/186 R; 5/199; 5/233; 403/100

[58] Field of Search ..... 272/65; 285/DIG. 19; 403/DIG. 7, 85, 100, 102; 5/11, 310, 314, 314 B, 186 R, 199, 230, 233, 111, 114, 116, 117; 182/139, 140

[56] References Cited

U.S. PATENT DOCUMENTS

| | | | |
|---|---|---|---|
| Re. 30,344 | 7/1980 | McNeil | 272/65 |
| 1,541,432 | 6/1925 | Mattingley | 5/310 |
| 2,430,714 | 11/1947 | Geer | 227/47 |
| 2,534,019 | 12/1950 | Griswold | 5/111 |
| 3,004,623 | 10/1961 | Nissen | 272/65 |
| 3,156,318 | 11/1964 | Sorenson et al. | 182/139 |
| 3,560,033 | 2/1971 | Barkus | 287/58 |
| 3,580,570 | 5/1971 | Fenner et al. | 272/65 |
| 3,891,208 | 6/1975 | Sidlinger | 272/65 |
| 3,892,403 | 7/1975 | Green | 272/65 |
| 4,162,063 | 7/1979 | Nissen et al. | 267/73 |
| 4,284,271 | 8/1981 | Pettit et al. | 272/65 X |

FOREIGN PATENT DOCUMENTS

| | | | |
|---|---|---|---|
| 2373302 | 12/1976 | France . | |
| 724244 | 2/1955 | United Kingdom | 272/65 |

OTHER PUBLICATIONS

Nissen Gymnasium Equipment 1975 Catalog, p. 27.

*Primary Examiner*—Richard J. Apley
*Assistant Examiner*—Stephen R. Crow
*Attorney, Agent, or Firm*—Fields, Lewis, Pittenger & Rost

[57] ABSTRACT

A rebound exerciser for use by an individual in performing a variety of exercises having a frame formed of two symmetrical sections, and a fexible, resilient mat secured to the frame by a plurality of coil springs. The two symmetrical sections are pivotally secured together by two diametrically opposed hinge assemblies which permit the sections to be pivoted to a first compact position wherein the sections are spaced-apart and superimposed to facilitate transportation and storage of the exerciser. The hinge assemblies further permit the sections to be pivoted to a second extended position wherein the sections are in substantially the same plane so that an individual can perform exercises utilizing the mat. The frame is supported above the surface onto which the exerciser is positioned by a plurality of leg members which are releasably secured to the frame. The exact location at which the plurality of coil springs which connect one side of the mat to one side of the frame is secured to the frame can be adjusted to adjust spring, and thus, mat tension to compensate for individuals of varying weights.

40 Claims, 12 Drawing Figures

Fig. 1
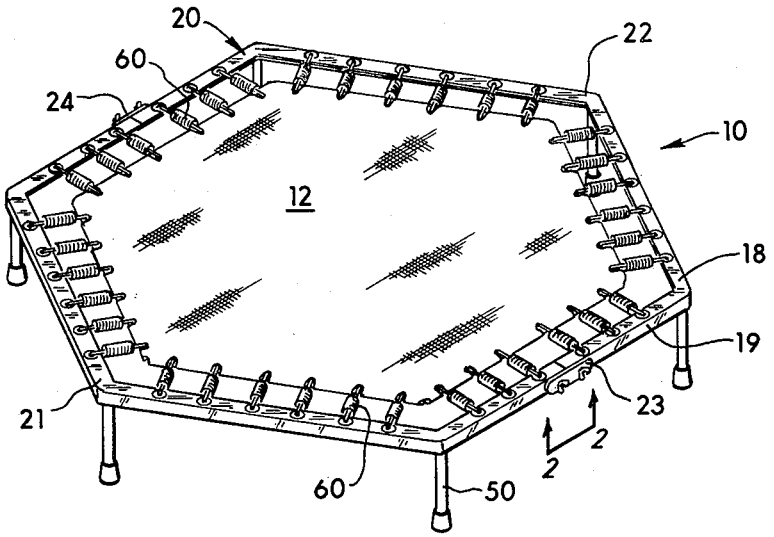
Fig. 2
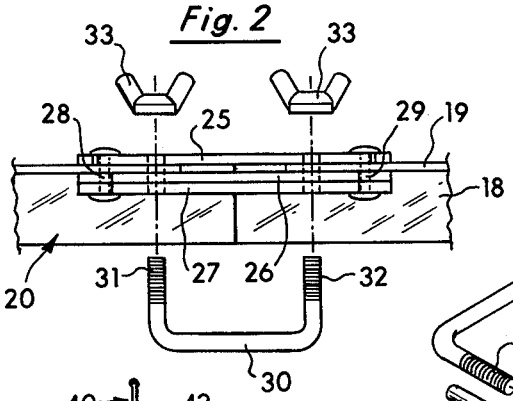
Fig. 3
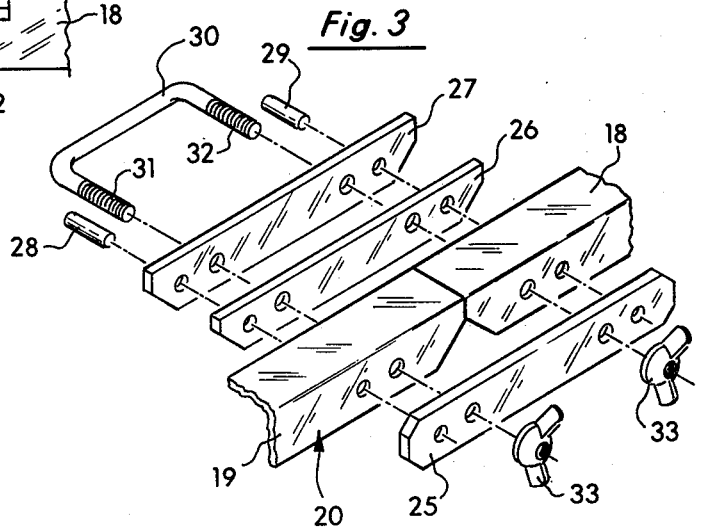
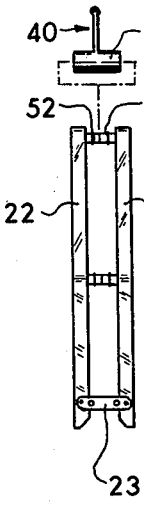
Fig. 4

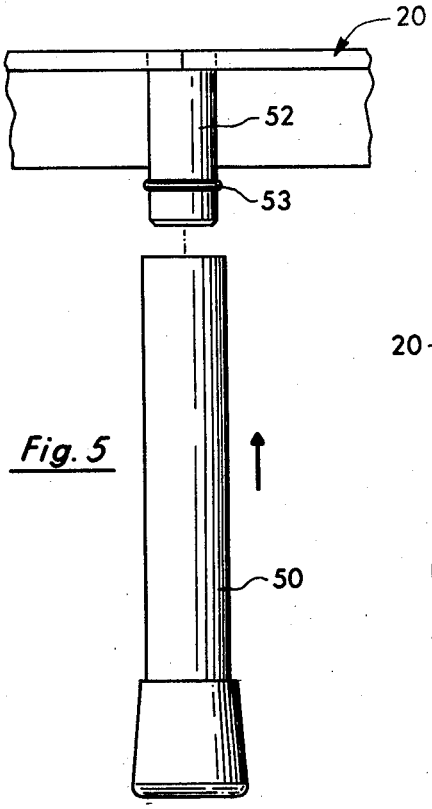
Fig. 5
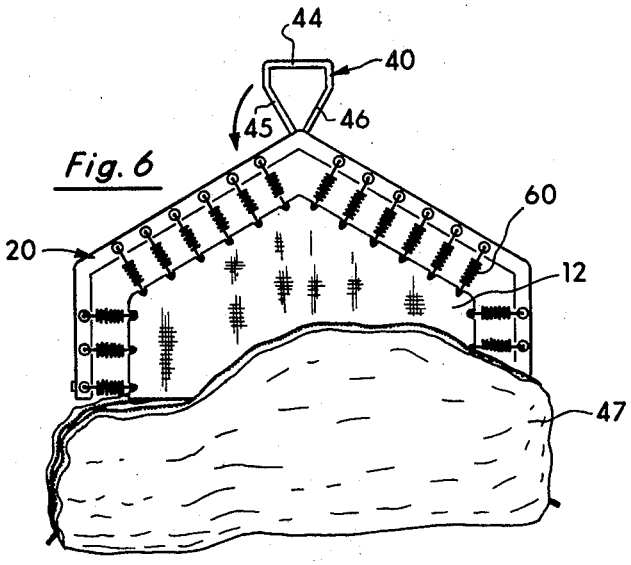
Fig. 6
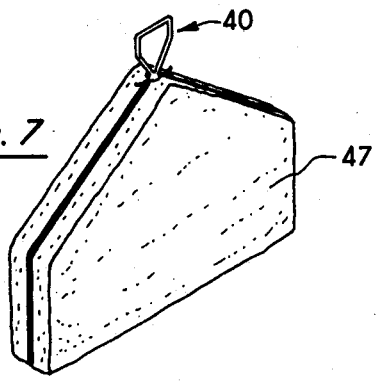
Fig. 7
Fig. 8
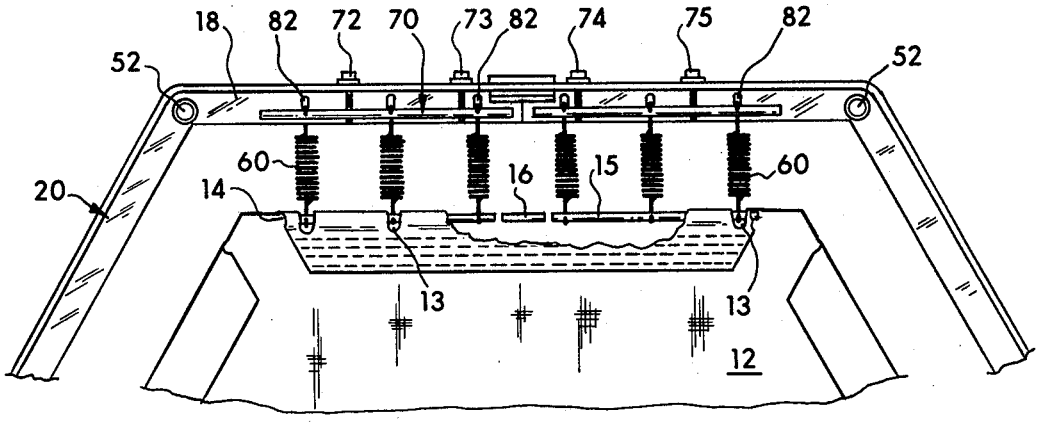

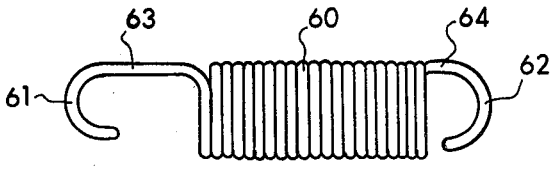
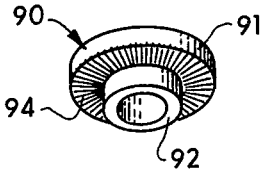
Fig. 9
Fig. 12
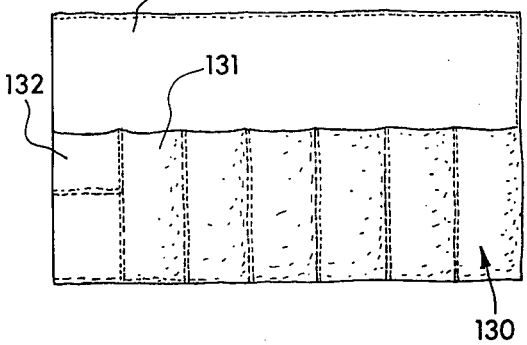
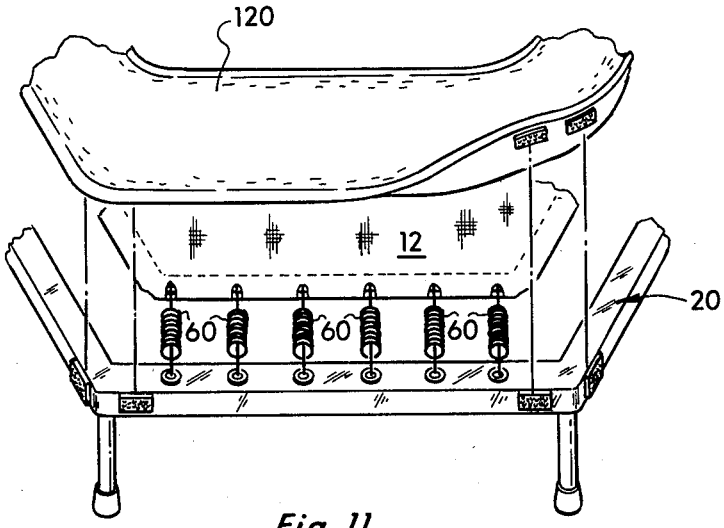
Fig. 11
Fig. 10
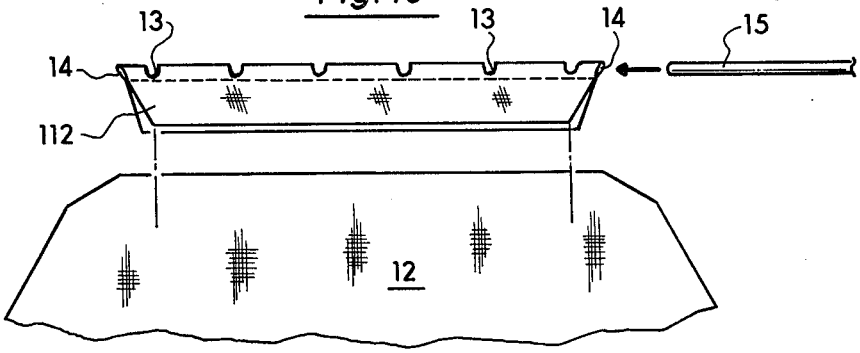

REBOUND EXERCISER

BACKGROUND OF THE INVENTION

1. Field of the Invention

The present invention relates to a rebound exerciser, and more particularly, to a portable rebound exerciser which is constructed to be readily compacted, and easily transported and stored, without removal of the mat from the frame, and to readily adjust mat tension for individuals of varying weight.

2. Description of the Prior Art.

Rebound exercisers generally consist of a mat of flexible, resilient webbing which is secured to a tubular frame by means of a plurality of coil springs. The frame is positioned a relatively short distance off the ground, for example, 7–8 inches, by a plurality of legs which are attached thereto. As fully assembled, an individual can perform a variety of aerobic exercises by, for example, flexing, jumping stretching, jogging, twisting, dancing, hopping, and kicking, while positioning some portion of his (her) body on the mat. Such exercises improve blood and lymph circulation and tone muscles due in part to increased cellular and muscular stress imparted by increased gravitational force encountered during such exercises. A variety of rebound exercisers are currently available on the market. However, none of these exercisers has proved to be totally acceptable.

One problem plaguing all prior art rebound exercisers is that due to the size thereof, the exercisers are not readily manipulated for tansportation and/or storage. A proposed prior art solution is to break down the exerciser into component parts, thus reducing the overall bulk of the exerciser. However, as reassembly of the exerciser, especialy the spring attachment to the mat and frame often involves the use of a separate tool and is difficult and time consuming, e.g., 1½ hours, this prior art approach to portability has not proved altogether viable. Further, once broken down, these prior art exercisers still do not meet the size requirements for shipping by United Parcel Service, and thus, shipping thereof is significantly more expensive.

It has also been proposed to equip prior art rebound exercisers with removable legs to increase compaction thereof. To date the prior art approach has been to secure a threaded female coupling at various points to the underside of the frame and thread the exterior of one end of each leg, as disclosed in U.S. Pat. No. 3,892,403 to Green. Each leg can then be coupled with the female coupling for use and uncoupled therefrom for transportation and/or storage as desired. However, as the mated threads are the sole point of support for the frame, these threads become damaged upon being subjected to repeated jarring during use of the exerciser therby increasing the difficulty of removing the legs and decreasing the stability of the overall frame.

Still another problem encountered in use of prior art exercisers is that the tension of the mat may be excessive or insufficient to suit the needs of the individual exercising. For example, a relatively lightweight individual may find a tight mat (i.e., a mat having a tension which is excessive in relationship to his weight) produces little or no spring during exercising and is uncomfortable and jarring. Prolonged exercising on this mat can result in injuries to the joints and internal system of an individual. Equally exemplary, a relatively heavy individual may find the same mat too loose (i.e., insufficient mat tension for his weight) resulting in minimal benefit from exercising since insignificant acceleration and deceleration (which increases the gravitational force on the body) is achieved. All of the prior art exercisers fail to provide for adjustment of spring, and thus, mat tension for varying individual weights.

Thus, a need exists for a rebound exerciser which can be readily compacted without total disassembly thereof for transportation and/or storage, which can be inexpensively shipped, and which provides for adjustment of spring and mat tension so as to accomodate individuals of varying weight.

BRIEF SUMMARY OF INVENTION

The present invention relates to a portable rebound exerciser having a frame which is formed of two substantially symmetrical sections and a mat formed of flexible, resilient webbing and secured to the frame by a plurality of coil springs. Two hinge assemblies pivotally secure the symmetrical sections together and permit the sections to be pivoted to a first compact position wherein the sections are spaced-apart and superimposed to facilitate transportation and storage of the exerciser. In the operational position where the two sections are in substantially the same plane, the hinge assemblies structural support for the frame. A plurality of leg members which may be removed by manual force support the frame above the surface onto which the exerciser is placed. The location at which the springs are secured to a given side of the frame can be varied to adjust the tension of the mat for different individual weights.

BRIEF DESCRIPTION OF THE DRAWINGS

The invention will be more readily undertood by reference to the accompanying drawing wherein like reference numerals are utilized to indicate like elements throughout the drawing figures and in which:

FIG. 1 is a perspective view of the rebound exerciser of the present invention in a fully extended position ready for use;

FIG. 2 is a cut away cross sectional view of one frame hinge taken along line 2—2 of FIG. 1;

FIG. 3 is a perspective, partially cut away, exploded view of the hinge of FIG. 2;

FIG. 4 is an end view of the rebound exerciser of the present invention in a compacted position;

FIG. 5 is a partially cutaway side view of a removal leg of the rebound exerciser of the present invention;

FIG. 6 is a side view of the rebound exerciser of the present invention in the compacted position of FIG. 4 and a carrying case therefor;

FIG. 7 is a perspective view of a carrying case utilized to protect the rebound exerciser of the present invention during transportation and storage;

FIG. 8 is a partially cut away bottom view of the frame adjustor means of the rebound exerciser of the present invention;

FIG. 9 is a perspective view of a coil spring and wear bushing employed in the rebound exerciser of the present invention;

FIG. 10 is a partially cut away perspective view of the mat utilized in the rebound exerciser of the present invention and the trim therefor;

FIG. 11 is a partially cut away perspective view of the rebound exerciser of the present invention equipped with a pad for covering coil springs during use; and FIG. 12 is a perspective view of a case utilized to transport and store certain disassembled component parts of the exerciser of the present invention.

DETAILED DESCRIPTION

The rebound exerciser of the present invention is illustrated in FIG. 1 generally as 10 and comprises a frame 20 and a resilient mat 12 which is secured to frame 20 by means of a plurality of coil springs 60, as hereinafter described. Frame 20 comprises two substantially identically configured sections 21 and 22 which can be releasably secured together in substantially the same plane (as illustrated in FIG. 1) by diametrically opposed hinge means 23 and 24. In this position, frame sections 21 and 22 cooperate to define an inner and an outer hexagonal peripheral configuration. Although a hexagonal peripheral configuration is preferred, it will be understood that any peripheral configuration capable of being formed of two symmetrical sections can be utilized in accordance with the present invention. Each frame section has an angular cross sectional configuration defining an upper portion 18; and an outer portion 19, which have substantially identical dimensions. For example, both upper portion and outer portion may have a width of $1\frac{1}{4}$ inches and a thickness of $\frac{1}{8}$ inches.

As illustrated in greater detail in FIGS. 2 and 3 each hinge means 23 and 24 comprises an outer plate 25 positioned along the exterior of outer portion 19 of frame sections 21 and 22 and spacer plate 26 and inner plate 27 which are positioned adjacent each other (as illustrated in FIG. 2) and along the interior of outer portion 19 of frame sections 21 and 22. Each of outer plate 25, spacer place 26 and inner plate 27 are positioned so as to be centered about the line at which sections 21 and 22 abut and spacer plate 26 and inner plate 27 are sized to abut upper portion 18 of both sections 21 and 22, and thus, to support both sections of frame 20 when the latter is in the position of FIG. 1. Outer plate 25, spacer plate 26 and inner plate 27 are all secured together near one end thereof by means of pin 28 which extends through a suitably sized bore in frame section 21 and near the other end thereof by means of pin 29 which extends through a bore in section 22. A locking means 30 can be employed in accordance with the present invention for locking frame sections 21 and 22 against relative pivotal movement when the latter are positioned in substantially same plane as illustrated in FIG. 1. Means 30 is a substantially U-shaped rod, preferrably constructed of metal, both free ends 31 and 32 of which are threaded. Each free end of locking means 30 can be inserted through one of bores 34 which extend through outer inner plate 25, spacer plate 26 and outer plate 27 and through outer portion 19 of frame sections 21 and 22 when the latter are in the fully extended position of FIG. 1. As thus inserted, nuts 33 can be mated with threaded free ends 31 and 32 of locking means 30 so as to prevent pivotal movement of frame sections 21 and 22 when the rebound exerciser of the present invention is in use. Preferably, nuts 33 are double threaded, double wing nuts.

As thus constructed, the rebound exerciser of the present invention can be releasably secured in the fully extended position illustrated in FIG. 1 and various exercises can be performed on mat 12 without damaging frame 20. When it is desired to store or transport the rebound exerciser of the present invention, locking means 30 is released (as illustrated in FIG. 2) by unmating nuts 33 from threaded ends 31 and 32 thereby allowing frame sections 21 and 22 to be manually pivoted about pins 28 and 29, respectively, into the compact position of FIG. 4. Thus, the rebound exerciser of the present invention can be folded into a portable position without the necessity of removing mat 12 and springs 60 from frame 20 and the problems attendant therewith. It is important to note that due in part to the flexibility of angular frame sections 21 and 22, substantially all of the tension on springs 60 is released when rebound exerciser 10 is compacted into the position of FIG. 4. When compacted, the overall dimensions of frame 20 actually collapse (e.g., up to 1 inch for a frame having a 40 inch width) so as to relieve the tension on springs 60. When folded into the fully extend position, hinge means 23 and 24 cooperatively act on frame 20 to extend the same back to its full width and tension springs 60. By removing the tension of springs 60 during storage and transportation, the useful life of the springs is significantly extended.

Referring now to FIG. 5, each corner of frame 20 is provided with a post or stud 52 which is fixedly secured thereto by any suitable means, such as, by means of welds. Preferably stud 52 is positioned through an aperture (not illustrated) and welded concurrently with the corners of frame 20. Each stud 52 has a substantially circular O-ring 53 constructed of suitable resilient material, for example, rubber, positioned in a groove or channel formed intermediate the length of stud 52. A leg member 50 has a substantially hollow cylindrical configuration, one end of which is closed. Leg member 50 is of a diameter such that when stud 52 is inserted through the open end thereof, O-ring 53 is compressed, for example, 0.005 inch, and serves to form an interference fit between stud 52 and leg member 50. The amount which O-ring 53 is compressed by leg member 50 can be varied but must be such that leg member 50 can be inserted over stud 52 by mere manual force. Thus, leg member 50 of the present invention can be easily inserted over stud 52 so as to abut frame 20 about substantially the entire circumference thereof while exerciser 10 is in use. Leg members 50 can also be readily removed from studs 52 by application of manual force to permit frame 20 to be folded to the position of FIG. 4 to permit storage and/or transportation.

To facilitate transportation of the rebound exerciser of the present invention, a handle 40 is provided to aid an individual in carrying the compacted unit. As best illustrated in FIGS. 4 and 6 handle 40 comprises a base 42 in the form of a hollow cylinder, a substantially U-shaped grip 44, and a pair of arm members 45 and 46. Arm members 45 and 46 have one end thereof secured to base 42 at spaced-apart locations which are positioned about the circumference of base 42. The other ends of arm members 45 and 46 are secured to opposite ends of grip 44. Preferably, grip 44 and arm members 45 and 46 have a substantially cylindrical cross sectional configurations. Handle 40 is preferably integrally constructed of a suitable material, such as, rubber or hard plastic. As thus assembled, base 42 can be inserted over opposing studs 52 when the rebound exerciser is folded into a compacted position (FIG. 4) and is sized to compress each O-ring 53 so as to form an interference fit with each stud. An individual can then grasp grip 44 and carry the exerciser. Additionally, arm members 45 and 46 diverge from their respective points of attachment to base 42 at substantially an identical angle to that included between sides of each frame section 21 and 22 so that handle 40 can be rotated within frame 20 during storage (as indicated be the arrow and dotted lines in FIG. 6). A carrying case 47 (FIG. 7) which has a pair of zippers for securing the case around the compacted exerciser while allowing handle 40 to protrude therefrom can be utilized to protect the rebound exerciser during transportation and/or storage.

Turing now to FIG. 8, a plurality of coil springs 60, both ends of which terminate in a hook, are illustrated as each having one end thereof secured to mat 12 via openings 13 and the other end thereof secured through an elongated aperture 82 formed in upper surface 18 of one side of frame 12. Apertures 82 are relatively uniformly spaced along each side of frame 20 and correspond in number to the number of springs utilized on each side of mat 12. A frame adjustment means 70 comprises a rod which may be severed into two sections and which extends substantially across the upper face of one side of frame 20 so as to partially block each of apertures 82. Preferably, the rod which extends along the side of frame 20 where frame sections 21 and 22 abut is severed (as illustrated) to permit the exerciser to be compacted. Threaded bolts 72, 73, 74 and 75 extend through appropriately sized bores formed in the outer face of the same side of frame 20 until the head of the former abuts washers 71 and are mated with threaded bores appropriately formed in the rod. Preferably, each head of bolts 72–75 has a hexagonally shaped bore formed in the outer end thereof so as to be manipulated by a conventional hex wrench. As thus constructed, bolts 72, 73, 74 and 75 can be uniformly rotated to move the rod(s) toward or away from mat 12, and accordingly, decrease or increase the tension of each spring 60 moved thereby. Alternatively, bolts 72, 73, 74 and 75 can be individually adjusted as desired. In this manner, the tension of springs 60 can be adjusted to compensate for the weight of a given exerciser by adjusting the location at which springs 60 attach to frame 20. It is important to note that when the overall peripheral configuration of frame 20 is hexagonal, adjustment means 70 need only be utilized on any three contiguous sides thereof in order to uniformly stretch mat 12 to a desired tension. The other three sides of frame 20 need be equipped with coil springs 60 only. When the frame adjustment means is utilized on only three sides of frame 20, it is preferred that the adjustment means be utilized on the side where frame sections 21 and 22 abut and on the two sides contiguous thereto. However, frame adjustment means 70 can be utilized on all sides of frame 20 when so desired.

It is important to note that the peripheral configuration of mat 12 corresponds to that of frame 20 and each edge of mat 12 defines channel 14, formed as hereinafter described. A rod 15 is inserted therein and one hooked-shaped end of each spring 60 is inserted through openings 13 and positioned around rod 15. Rod 15 serves to apportion the force applied via springs 60 equally along the edge of mat 12, and also, increases the bearing surface for the hook of springs 60 so as to increase the useful thereof. The channels of the edges of mat 12 which are secured to the sides of frame 20 where frame sections 21 and 22 abut are preferably equipped with a relatively soft plastic center section 16 and two metal rods so as to allow frame 20 to be folded into the compacted position of FIG. 4. Alternatively, center section 16 can be entirely omitted.

As illustrated in FIG. 9, it is preferred that the hook-shaped end 61 of springs 60 which is attached to frame 20 via apertures 82 have a relatively straight shaft portion 63 which possesses a substantially greater length than shaft portion 64 of the other hook-shaped end 62. The exact length of shaft portion 63 can be varied but in any event must be such that end 61 can be positioned from one end to the other of aperture 83 without permitting the coiled section of spring 60 to contact the edge of frame 20. In this manner, problems associated with the coiled portion of spring 60 contacting the edge of frame 20 such as, excessive wear and damage to frame 20 during use, at the point of contact loss of the entire range of adjustment of the spring tension, and excessive noise during use, are obviated.

As also illustrated in FIG. 8, a wear bushing 90 comprises a first generally cylindrical portion 91 and a second generally cylindrical portion 92, integrally formed with and having a small diameter than first portion 91. A bore 93 extends through first portion 91 and second portion 92. Second portion 92 may be inserted through apertures 82 formed in the upper portion 19 of the sides of frame 20 which are not equipped with frame adjustment means 70. As inserted, annular shoulder 94 formed between first portion 91 and second portion 92 abuts the upper portion 19 of frame 20. A hook shaped end of spring 60 can be then inserted through bore 93 and wears against bushing 90 instead of frame 20, thus extending the useful life of the latter.

The preferred construction of mat 12 of the exerciser of the present invention will be more readily understood by referring to FIG. 10. The exact configuration of mat 12 is hot cut from a sheet of polypropylene webbing by, for example, use of a knife possessing a heated blade so as to heat seal the edges of mat 12 to retard fraying and unravelling caused by use. Trime 112 for each edge of mat 12 is formed by cutting a rectangular configuration from a sheet of nylon or polypropylene webbing and heat sealing the edges thereof. Trim 112 is then folded to form two symmetrical halves which are stitched intermediate the width and along substantially the entire length thereof so as to be substantially parallel to the edges thus forming channel 14. Openings 13 are formed along the edge of trim 112 by burning with a suitably configured heated dye. Next, the free edges of trim 112 are positioned on opposite surfaces of mat 12, aligned with an edge thereof, and stitched to mat 12 along substantially the entire length of trim 112. In this manner, mat 12 of the present invention is readily constructed to withstand the forces applied thereto during use without encountering substantial amounts of fraying or unravelling.

A pad 120 is illustrated in FIG. 11 and has an outer and a inner periphery both of which substantially correspond to that of frame 20 and mat 12. Pad 120 has a width sufficient to cover springs 60 when attached to frame 20. It is preferred to attach pad 120 to frame 20 by means of a plurality of adhesive hooks or pile pads, such as, corresponding Velcro strips, which correspond in number to a plurality of complimentary pads or hooks secured about the exterior of the outer portion of frame 20. As thus secured to frame 20, pad 120 functions to protect both springs 60 and the individual exercising from injury, and can be easily attached to and readily removed from pad 120.

A case 130 as illustrated in FIG. 12 may be provided for carrying disassembled leg members 50 in pockets 131 and disassembled locking means 30 in pocket 132. Flap 133 can be folded over pockets 131 and pocket 132 and case 130 can be rolled up and secured by means of ties (not illustrated) attached to the other side of case 130. Case 130 can then be inserted into carrying case 47 for transportation and storage. Case 130 can be constructed of any suitable material, such as, soft plastic or cloth.

While various embodiments and modifications of this invention have been described in the foregoing description, further modifications will be apparent to those skilled in the art. Such modifications are included within the scope of this invention as defined by the following claims.

I claim:

1. A rebound exerciser kit having component parts capable of being assembled at a given site so as to provide a rebound exerciser for use by an individual, the exerciser kit comprising:

a frame means formed of two substantially symmetrical sections disposed opposite one another, each frame section having two end portions to provide two pairs of opposed end portions;

a mat of flexible, resilient webbing;

a plurality of coil springs, each of said plurality of coil springs having one end thereof releasably secured to said mat and the other end thereof releasably secured to said frame means;

hinge and locking means for pivotally securing said symmetrical sections together and for releasably locking said sections during use of said exerciser, said hinge and locking means permitting said sections to be pivoted to a first compact position wherein said sections are spaced apart and superimposed to facilitate transportation and storage of said kit, said hinge and locking means further permitting said sections to be pivoted to a second extended position wherein said sections are in substantially the same plane to permit an individual to perform exercises on said mat, said hinge and locking means including two diametrically opposed hinge and locking assemblies, each said hinge and locking assembly including at least one plate means extending along each of said pairs of opposed end portions, a pivot member extending through each said plate means and each of said opposed end portions to provide two pairs of spaced pivot members, and a locking member extending through each plate means and each end portion between each of said pairs of spaced pivot members; and means for supporting said frame means in a position spaced above a surface onto which said rebound exerciser is placed, said supporting means adapted to be releasably secured to said frame means by manual manipulation when said sections are in said second extended position and adapted to be removed from said frame means by manual manipulation when said sections are in said first compact position.

2. The exerciser kit of claim 1 wherein said two symmetrical sections define a substantially hexagonal peripheral configuration in said second extended position.

3. The exerciser kit of claim 2 wherein said mat has a substantially hexagonal peripheral configuration.

4. The exerciser kit of claim 1 wherein said sections have an angular cross section which defines an outer portion and an upper portion.

5. The exerciser kit of claim 4 wherein each plate means comprises:

a first elongated plate positioned contiguous to one face of the outer portion of said frame means;

an elongated spacer plate positioned contiguous to the other face of the outer portion of said frame means; and a second elongated plate positioned contiguous to said elongated spacer plate, said pivot members and locking member for each of said opposed end portions extending through associated of said first, spacer, and second elongated plates, said elongated spacer plate and said second plate supporting said upper surface of said frame means when said sections are in said second extended position.

6. The exerciser kit of claim 5 wherein each of said first, spacer and second plates of each hinge assembly has a pair of spaced-apart, aligned bores therethrough which also extend through said frame means.

7. The exerciser kit of claim 6 wherein said locking member comprises:

a substantially U-shaped rod having two threaded ends which are adapted to be inserted through said pair of spaced-apart, aligned bores when said sections are in said second extended position; and a pair of double threaded nuts adapted to be mated with said threaded ends when said threaded ends are inserted through said pair of bores so as to releasably secure said sections in said second extended position.

8. The exerciser kit of claim 1 wherein said frame means has a plurality of substantially cylindrical studs secured thereto and depending therefrom in substantially the identical direction, each of said studs having a channel formed therein intermediate the length thereof and having a resilient O-ring positioned in said channel, and wherein said supporting means comprising;

a plurality of leg members corresponding in number to said plurality of studs, each of said leg members having a substantially hollow cylindrical configuration which has one closed end and one open end, and each of said leg members adapted to allow a separate one of said studs to be inserted through the open end thereof to compress said O-ring and form an interference fit therebetween.

9. The exerciser kit of claim 8 further comprising:

means for gripping adapted to be releasably secured to an oppossed pair of said studs when said sections are in said first compact position so as to aid in manual transportation of said exerciser.

10. The exerciser kit of claim 9 wherein said gripping means comprises:

a hollow, substantially cylindrical base having two open ends, said base adapted to be inserted over said opposed studs;

a substantially U-shaped grip; and a pair of arm members having one end thereof secured at spaced apart locations about the circumference of said base, the other end of each of said pair of arm members being secured to a separate end of said grip, said base further adapted to be rotated about said opposed studs to position said grip and said pair of arm members within said frame means so as to facilitate storage of said exerciser kit.

11. The exerciser kit of claim 1 wherein each of said coil springs terminates in a first hook shaped end which is secured to said mat via one of a plurality of apertures formed in said mat and in a second hook shaped end which is secured to said frame means via one of a plurality of apertures formed in said frame means.

12. The exerciser kit of claim 11 wherein the shank of said second hook shaped end is of a substantially greater length than the shank of said first hook shaped end.

13. The exerciser kit of claim 11 further comprising:

at least one wear bushing adapted to be inserted into at least one of said plurality of apertures formed in said frame means, said wear bushing having a first substantially cylindrical portion and a second substantially cylindrical portion having a substantially greater diameter than said first portion and being secured to said first portion, said first and second portions defining a shoulder therebetween which abuts said frame means when said wear bushing is inserted into said one aperture, said first and second portions having a bore therethrough adapted to receive said second hook shaped end of one of said coil springs.

14. The exerciser kit of claim 11 wherein said frame means and said mat have at least four sides and wherein each edge of said mat defines a channel having two open ends, said channel having a plurality of apertures formed along the length thereof and having at least one rod inserted therein, said at least one rod having a length substantially identical to the length of said edge.

15. The exerciser kit of claim 1 further comprising:

a pad adapted to be affixed by means of a plurality of adhesive pile strips to corresponding strips of adhesive hooks secured to said frame means when said sections are in said second extended position, said pad thereby protecting said springs from damage and said individual from injury during use of said exerciser.

16. The exerciser kit of claim 11 wherein said frame means and said mat have at least four sides, said exerciser kit further comprising:

means for simultaneously adjusting the exact location at which said second hook shaped end of a plurality of said coil springs which are utilized to secure one side of said mat to one side of said frame is secured to said frame means.

17. The exerciser kit of claim 16 wherein said frame means has a hexagonal peripheral configuration and wherein said adjusting means is utilized on three contiguous sides thereof.

18. A rebound exerciser for use by an individual in performing a variety of exercises, the exerciser comprising:

a frame means formed of two substantially symmetrical sections disposed opposite one another, each frame section having two end portions to provide two pairs of opposed end portions;

a mat of flexible, resilient webbing;

a plurality of coil springs, each of said plurality of coil springs having one end thereof releasably secured to said mat and the other end thereof releasably secured to said frame means;

hinge and locking means for pivotally securing said symmetrical sections together and for releasably locking said sections during use of said exerciser, said hinge and locking means permitting said sections to be pivoted to a first compact position wherein said sections are spaced apart and superimposed to facilitate transportation and storage of said exerciser, said hinge and locking means further permitting said sections to be pivoted to a second extended position wherein said sections are in substantially the same plane to permit an individual to perform exercises on said mat, said hinge and locking means including two diametrically opposed hinge and locking assemblies, each said hinge and locking assembly including at least one plate means extending along each of said pairs of opposed end portions, a pivot member extending through each said plate means and each of said opposed end portions to provide two pairs of spaced pivot members and a locking member extending through each plate means and each end portion between each of said pairs of spaced pivot members; and means for supporting said frame means in a position spaced above a surface onto which said rebound exerciser is placed, said supporting means releasably secured to said frame means by manual manipulation when said sections are in said second extended position and adapted to be removed from said frame means by manual manipulation when said sections are in said first compact position.

19. The exerciser of claim 18 wherein said two symmetrical sections define a substantially hexagonal peripheral configuration in said second extended position.

20. The exerciser of claim 19 wherein said mat has a substantially hexagonal peripheral configuration.

21. The exerciser of claim 18 wherein said sections have an angular cross section which defines an outer portion and an upper portion.

22. The exerciser of claim 21 wherein each plate means comprises:

a first elongated plate positioned contiguous to the other face of the outer portion of said frame means;

an elongated spacer plate positioned contiguous to the other fact of the outer portion of said frame means; and a second elongated plate positioned contiguous to said elongated spacer plate, said pivot members and locking member for each of said opposed end portions extending through associated of said first, spacer, and second elongated plates, said elongated spacer plate and said second plate supporting said upper surface of said frame means when said sections are in said second extended position.

23. The exerciser of claim 22 wherein each of said first, spacer and second plates of each hinge assembly has a pair of spaced-apart, aligned bores therethrough which also extend through said frame means.

24. The exerciser of claim 23 wherein said locking member comprises:

a substantially U-shaped rod having two threaded ends which are inserted through said pair of spaced-apart, aligned bores when said sections are in said second extended position; and a pair of double threaded nuts mated with said threaded ends when said threaded ends are inserted through said pair of bores so as to releasably secure said sections in said second extended position.

25. The exerciser of claim 18 wherein said frame means has a plurality of substantially cylindrical studs secured thereto and depending therefrom in substantially the identical direction, each of said studs having a channel formed therein intermediate the length thereof and having a resilient O-ring positioned in said channel, and wherein said supporting means comprising;

a plurality of leg members corresponding in number to said plurality of studs, each of said leg members having a substantially hollow cylindrical configuration which has one closed end and one open end, and each of said leg members having separate one of said studs inserted through the open end thereof to compress said O-ring and form an interference fit therebetween.

26. The exerciser of claim 18 wherein each of said coil springs terminates in a first hook shaped end which is secured to said mat via one of a plurality of apertures formed in said mat and in a second hook shaped end which is secured to said frame means via one of a plurality of apertures formed in said frame means.

27. The exerciser of claim 26 wherein the shank of said second hook shaped end is of a substantially greater length than the shank of said first hook shaped end.

28. The exerciser of claim 26 further comprising:

at least one wear bushing inserted into at least one of said plurality of apertures formed in said frame means, said wear bushing having a first substantially cylindrical portion and a second substantially cylindrical portion having a substantially greater diameter than said first portion and being secured to said first portion, said first and second portions defining a shoulder therebetween which abuts said frame means, said first and second portions having a bore therethrough to receive said second hook shaped end of one of said coil springs.

29. The exerciser of claim 26 wherein said frame and said mat have at least four sides and wherein each edge of said mat defines a channel having two open ends, said channel having a plurality of apertures formed along the length thereof and having at least one rod inserted therein, said at least one rod having a length substantially identical to the length of said edge.

30. The exercisser of claim 18 further comprising:

a pad affixed by means of a plurality of adhesive pile strips to corresponding strips of adhesive hooks secured to said frame means when said sections are in said second extended position, said pad thereby protecting said spring from damage and said individual from injury during use of said exerciser.

31. The exerciser of claim 26 wherein said frame means and said mat have at least four sides, said exercise further comprising:

means for simultaneously adjusting the exact location at which said second hook shaped end of a plurality of said coil springs which are utilized to secure one side of said mat to one side of said frame is secured to said frame means.

32. The exerciser of claim 31 wherein said frame means has a hexagonal peripheral configuration and wherein said adjusting means is utilized on three contiguous sides thereof.

33. A rebound exerciser kit having component parts capable of being assembled at a given site so as to provide a rebound exerciser for use by an individual, the exerciser kit comprising:

a frame means formed of two substantially symmetrical sections;

a mat of flexible, resilient webbing;

a plurality of coil springs, each of said plurality of coil springs having one end thereof releasably secured to said mat and the other end thereof releasably secured to said frame means;

hinge means for pivotally securing said symmetrical sections together, said hinge means permitting said sections to be pivoted to a first compact position wherein said sections are spaced apart and superimposed to facilitate transportation and storage of said kit, said hinge means further permitting said sections to be pivoted to a second extended position wherein said sections are in substantially the same plane to permit an individual to perform exercises on said mat; and means for supporting said frame means in a position spaced above a surface onto which said rebound exerciser is placed, said supporting means adapted to be releasably secured to said frame means by manual manipulation when said sections are in said second extended position and adapted to be removed from said frame means by manual manipulation when said sections are in said first compact position, each of said coil springs terminating in a first hook-shaped end which is secured to said mat via one of a plurality of apertures formed in said mat and in a second hook-shaped end which is secured to said frame means via one of a plurality of apertures formed in said frame means, said frame means and said mat having at least four sides and each edge of said mat defining a channel having two open ends, said channel having a plurality of apertures formed along the length thereof and having at least one rod inserted therein, said at least one rod having a length substantially identical to the length of said edge, two opposed edges of said mat each having three rods inserted into said channel, the central rod being formed of a relatively flexible material to permit said sections to be pivoted on said first compact position.

34. A rebound exerciser kit having component parts capable of being assembled at a given site so as to provide a rebound exerciser for use by an individual, the exerciser kit comprising:

a frame means formed of two substantially symmetrical sections;

a mat of flexible, resilient webbing;

a plurality of coil springs, each of said plurality of coil springs having one end thereof releasably secured to said mat and the other end thereof releasably secured to said frame means;

hinge means for pivotally securing said symmetrical sections together, said hinge means permitting said sections to be pivoted to a first compact position wherein said sections are spaced apart and superimposed to facilitate transportation and storage of said kit, said hinge means further permitting said sections to be pivoted to a second extended position wherein said sections are in substantially the same plane to permit an individual to perform exercises on said mat;

means for supporting said frame means in a position spaced above a surface onto which said rebound exerciser is placed, said supporting means adapted to be releasably secured to said frame means by manual manipulation when said sections are in said second extended position and adapted to be removed from said frame means by manual manipulation when said sections are in said first compact position, each of said coil springs terminating in a first hook-shaped end which is secured to said mat via one of a plurality of apertures formed in said mat and in a second hook-shaped end which is secured to said frame means via one of a plurality of apertures formed in said frame means, said frame means and said mat having at least four sides, said exerciser kit further comprising means for simultaneously adjusting the exact location at which said second hook-shaped end of a plurality of said coil springs which are utilized to secure one side of said mat to one side of said frame is secured to said frame means, said frame means having an angular cross section defining an outer portion and an upper portion and said one side of said frame means having a plurality of spaced-apart, elongated apertures formed therein which correspond in number to said plurality of coil springs attached to said one side of said frame means, said adjusting means comprising at least one rod sized to extend across all of said plurality of apertures in said one side of said frame means, said at least one rod being positioned adjacent one face of said upper portion; and means for variably positioning said at least one rod with respect to said outer portion of said frame means so as to variably position said at least one rod with respect to said plurality of apertures in said upper portion of said one side, each said second hook-shaped end of said plurality of coil springs being inserted through a separate aperture of said plurality of elongated apertures via the other face of said upper portion and extending around said at least one rod so that variably positioning said at least one rod will correspondingly alter the tension of said coil springs.

35. The excerciser kit of claim 34 wherein said variable positioning means comprises at least two bolts, each bolt having a head and a threaded shank which is mated with a separate threaded bore in said at least one rod, said head abuting said outer portion of said frame means.

36. The exerciser kit of claim 35 wherein said variable positioning means comprises four of said bolts.

37. A rebound exerciser for use by an individual in performing a variety of exercises, the exerciser comprising:

a frame means formed of two substantially symmetrical sections;

a mat of flexible, resilient webbing;

a plurality of coil springs, each of said plurality of coil springs having one end thereof releasably secured to said mat and the other end thereof releasably secured to said frame means;

hinge means for pivotally securing said symmetrical sections together, said hinge means permitting said sections to be pivoted to a first compact position wherein said sections are spaced apart and superimposed to facilitate transportation and storage of said exerciser, said hinge means further permitting said sections to be pivoted to a second extended position wherein said sections are in substantially the same plane to permit an individual to perfom exercises on said mat; and means for supporting said frame means in a position spaced above a surface onto which said rebound exerciser is placed, said supporting means releasably secured to said frame means by manual manipulation when said sections are in said second extended position and adapted to be removed from said frame member by manual manipulation when said sections are in said first compact position, each of said coil springs terminating in a first hook-shaped end which is secured to said mat via one of a plurality of apertures formed in said mat and in a second hook-shaped end which is secrued to said frame means via one of a plurality of apertures formed in said frame means, said frame means and said mat having at least four sides and each edge of said mat defining a channel having two open ends, said channel having a plurality of apertures formed along the length thereof and having at least one rod inserted therein, said at least one rod having a length substantially identical to the length of said edge, two opposed edges of said mat each having three rods inserted into said channel, the central rod being formed of a relatively flexible material to permit said sections to be pivoted to said first compact position.

38. A rebound exerciser for use by an individual in performing a variety of exercises, the exerciser comprising:

a frame means formed of two substantially symmetrical sections;

a mat of flexible, resilient webbing;

a plurality of coil springs, each of said plurality of coil springs having one end thereof releasably secured to said mat and the other end thereof releasably secured to said frame means;

hinge means for pivotally securing said symmetrical sections together, said hinge means permitting said sections to be pivoted to a first compact position wherein said sections are spaced apart and superimposed to facilitate transportation and storage of said exerciser, said hinge means further permitting said sections to be pivoted to a second extended position wherein said sections are in substantially the same plane to permit an individual to perform exercises on said mat;

means for supporting said frame means in a position spaced above a surface onto which said rebound exerciser is placed, said supporting means releasably secured to said frame means by manual manipulation when said sections are in said second extended position and adapted to be removed from said frame member by manual manipulation when said sections are in said first compact position, each of said coil springs terminating in a first hook-shaped end which is secured to said mat via one of a plurality of apertures formed in said mat and in a second hook-shaped end which is secured to said frame means via one of a plurality of apertures formed in said frame means said frame means and said mat having at least four sides, said exerciser further comprising means for simultaneously adjusting the exact location at which said second hook-shaped end of a plurality of said coil springs which are utilized to secure one side of said mat to one side of said frame is secured to said frame means, said frame means having an angular cross section defining an outer portion and an upper portion and said one side of said frame means having a plurality of spaced-apart, elongated apertures formed therein which correspond in number to said plurality of coil springs attached to said one side of said frame means, said adjusting means comprising at least one rod sized to extend across all of said plurality of apertures in said one side of said frame means, said at least one rod being positioned adjacent one face of said upper portion; and means for variably positioning said at least one rod with respect to said outer portion of said frame means so as to variably position said at least one rod with respect to said pluraliy of apertures in said upper portion of said one side, each said second hook-shaped end of said plurality of coil springs being inserted through a separate aperture of said plurality of elongated apertures via the other face of said upper portion and extending around said at least one rod so that variably positioning said rod will correspondingly alter the tension of said coil springs.

39. The exerciser of claim 38 wherein said variable positioning means comprises at least two bolts, each bolt having a head and a threaded shank which is mated with a separate threaded bore in said at least one rod, said head abuting said outer portion of said frame means.

40. The exerciser of claim 39 wherein said variable positioning means comprises four of said bolts.

* * * * *